US005467831A

United States Patent [19]

Spektor

[11] Patent Number: 5,467,831

[45] Date of Patent: Nov. 21, 1995

[54] MONOTUBE DIFFERENTIAL PNEUMOPERCUSSIVE REVERSIBLE SELF-PROPELLED SOIL PENETRATING MACHINE WITH STABILIZERS

[76] Inventor: Michael B. Spektor, 1030 Tamera Dr., Klamath Falls, Oreg. 97603

[21] Appl. No.: 294,070

[22] Filed: Aug. 22, 1994

[51] Int. Cl.[6] ..... E21B 4/14; E21B 7/26

[52] U.S. Cl. ..... 175/19; 166/301; 173/91; 175/57

[58] Field of Search ..... 175/19, 57, 296, 175/293; 166/301; 173/91

[56] References Cited

U.S. PATENT DOCUMENTS

| | | | |
|---|---|---|---|
| 3,651,874 | 3/1972 | Sudnishnikov et al. | 173/91 |
| 3,708,023 | 1/1973 | Nazarov et al. | 175/19 |
| 3,727,701 | 4/1973 | Sudnishnikov et al. | 173/91 |
| 3,744,576 | 7/1973 | Sudnishnikov et al. | 173/91 |
| 3,756,328 | 9/1973 | Sudnishnikov et al. | 173/91 |
| 3,865,200 | 2/1975 | Schmidt | 175/19 |
| 4,078,619 | 3/1978 | Sudnishnikov et al. | 175/19 |
| 4,249,620 | 2/1981 | Schmidt | 175/53 |
| 4,749,050 | 6/1988 | Ritter | 175/19 |
| 5,031,706 | 7/1991 | Spektor | 175/19 |
| 5,226,487 | 7/1993 | Spektor | 175/19 |
| 5,311,950 | 5/1994 | Spektor | 175/19 |

OTHER PUBLICATIONS

Minimization of Energy Consumption of Soil Deformation, by Spektor, *Journal of Terramechanics,* 1980, vol. 17, No. 2, pp. 63–77.

Principles of Soil–Tool Interaction, by Specktor, *Journal of Terramechanics,* 1981, vol. 18, No. 1, pp. 51–65.

Motion of Soil–Working Tool Under Impact Loading, by Spektor, *Journal of Terramechanics,* 1981, vol. 18, No. 3, pp. 133–156.

Working Process of Cyclic–Action Machinery for Soil Deformation—Part I, by Spektor, *Journal of Terramechanics,* 1983, vol. 20, No. 1, pp. 13–41.

Minimum Energy Consumption of Soil Working Cyclic Processes, by Spektor, *Journal of Terramechanics,* 1987, vol. 24, No. 1, pp. 95–107.

*Primary Examiner*—Hoang C. Dang

[57] ABSTRACT

The invention represents a monotube differential pneumopercussive self-propelled reversible soil penetrating machine with stabilizers (100) having an increased efficiency, reliability, durability, and directional stability, and also a lower cost compared to existing machines. All of these achievements are associated in part with the development of an innovative monotube housing with rigidly secured to its outside surface structurally shaped longitudinal directional stabilizers, creating closed longitudinal air passages between the outside surface of the monotube housing and inside surface of the structurally shaped stabilizers. The invention offers a rigid connection of the air-distributing mechanism without use of any tail nuts, which simplifies the machine and reduces its cost. The chisel assembly is simplified and the overall weight of the machine is reduced. All this causes in a more efficient transfer of impact energy the housing and also more efficient use of the internal cross-sectional area of the housing in terms of developing an increased pressure force for the same outside diameter in comparison with the existing machines. The invention also offers a method of retracting a failed machine (100) from the underground hole by a similar or identical machine. The required for this method simple modifications of the rear and front parts of the machine (100) and appropriate accessories are also described in this invention.

5 Claims, 14 Drawing Sheets

SECTION 2-2

SECTION 1-1

SECTION 5-5

SECTION 4-4

SECTION 3-3

SECTION 6-6

SECTION 7-7

SECTION 8-8

MONOTUBE DIFFERENTIAL PNEUMOPERCUSSIVE REVERSIBLE SELF-PROPELLED SOIL PENETRATING MACHINE WITH STABILIZERS

FIELD OF THE INVENTION

The present invention relates to vibropercussive pneumatically operated self-propelled soil penetrating machines used basically for horizontal trenchless hole making under roads, air fields, and other objects at building or repair of underground lineal communications. These machines are used also for driving pipes and cables into the holes. In mining industry, these machines are used for driving explosives into the holes.

BACKGROUND OF THE INVENTION

Pneumatically operated reversible self-propelled soil penetrating machines for underground hole making are known. Basically these machines comprise a hollow cylindrical body, accommodating a piston-striker and an air distributing mechanism. The front part of the body represents an front anvil with a pointed chisel. A tail nut is screwed in into the rear part of the body, keeping together the components of the air distributing mechanism, the front part of which represents a rear anvil. The air distributing mechanism, comprising controls for forward and reverse modes of operation, causes the piston-striker to reciprocate, imparting significant impacts to the front or to the rear anvil. A machine operation cycle includes a forward and backward stroke of the piston-striker. In the forward mode of operation, the piston-striker at the end of its forward stroke imparts an impact to the front anvil resulting in an incremental body soil penetrating. During the backward stroke, the piston-striker is braked by an air buffer in order to prevent or minimize an impact to the rear anvil. In the reverse mode operation the piston-striker is braked during its forward stroke to eliminate an impact to the front anvil. During the backward stroke the piston-striker imparts an impact to the rear anvil, so that the body moves backward a certain increment of displacement.

Pneumatically operated machines of this type are described in U.S. Pat. Nos. 3,651,874 (3/1972); 3,708,023 (1/1973); 3,727,701 (4/1973); 3,744,576 (7/1973); 3,756,328 (9/1973); 3,865,200 (2/1975); 4,078,619 (3/1978); 4,214,638 (7/1980). The machines according to these patents are characterized by relatively short strokes of the piston-striker, which cause in relatively low impact energy per cycle resulting in high energy consumption at low productivity of the working process. A detailed analysis of these patents is presented in the U.S. Pat. Nos. 5,031,706 and 5,226,487 issued to Spektor (the author of the present invention) in July, 1991 and in July, 1993 respectively.

Analysis of the working process of the existing machines (based on the research investigations, published by the present inventor), shows that the mentioned working process is characterized by relatively high energy consumption at relatively low productivity (average velocity). The theory of minimization of energy consumption of soil working cyclic processes, developed and published by the present inventor, indicates that the process of vibratory soil penetration can be optimized with respect to minimum energy consumption. (See: Minimization of Energy Consumption of Soil Deformation, Journal of Terramechanics, 1980, Volume 17, No. 2, pages 63 to 77; Principles of Soil-Tool Interaction, Journal of Terramechanics, 1981, Volume 18, No. 1, pages 51 to 65; Motion of Soil-Working Tool Under Impact Loading, Journal of Terramechanics, 1981, Volume 18, No. 3, pages 133 to 136; Working Processes of Cyclic-Action Machinery for Soil Deformation—Part I, Journal of Terramechanics, 1983, Volume 20, No. 1, pages 13 to 41; Minimum Energy Consumption of Soil Working Cyclic Processes, Journal of Terramechanics, 1987, Volume 24, No. 1, pages 95 to 107). These investigations indicate that in order to optimize the working process, the impact energy of the striker should be significantly increased, which can be achieved with a long stroke air distributing mechanism. Following the outcome of these investigations, the author developed a differential pneumopercussive reversible self-propelled soil penetrating machine, which is characterized by a long stroke air distributing mechanism. This machine is described in the U.S. Pat. No. 5,311,950 issued to Spektor (the author of the present invention) in May, 1994. According to this patent, the machine includes, as major assemblies, an elongated compound housing assembly, comprising an outer tube which concentrically accommodates an inner tube creating a tubular space between these tubes; a striker assembly disposed for reciprocation within the inner tube; a front anvil assembly rigidly secured to the front part of the inner tube comprising an elastic link and a chisel; a rear anvil assembly rigidly secured to the inner tube rearwardly of the striker assembly; a differential valve-operated air distributing mechanism secured in the inner tube rearwardly of the rear anvil assembly; and a tail nut assembly for securing together the outer and inner tubes and keeping in place the air-distributing mechanism.

The testing of the machine described in the U.S. Pat. No. 5,311,950 has demonstrated positive results, however the engineering analysis of this machine shows several structural disadvantages which decrease the efficiency of the machine and increase its cost.

The most essential disadvantage is associated with the structure of the compound housing comprising the outer and inner tubes. First of all, the mass of this housing is relatively much bigger than the mass of the striker which results in a relatively low efficiency transfer of impact energy from the striker to the housing. Secondly, the summarized wall thickness of these two concentric tubes causes a relatively significant decrease in the diameter of the striker, and , consequently, the pressure force is respectively reduced, resulting in a relatively low impact energy per cycle for the given outside diameter of the machine. All this does not allow to obtain a relatively high efficiency of the machine performance. Thirdly, the components for keeping the tubes concentrically and also the longitudinal elastic strips, located between the tubes, increase the manufacturing cost and complexity of the machine.

Another disadvantage of the considered machine is related to the tail nut assembly, which may become loose, and then cause the termination of the functioning of the machine. The components of this assembly also increase the manufacturing cost and the complexity of the machine.

A further disadvantage of the considered machine is associated with the complexity of the front anvil assembly and low durability of the elastic diaphragm of this assembly which result in increasing of the cost of manufacturing and maintenance of the machine.

Still another inherent disadvantage of the considered machine as well as all other similar existing machines is the absence of means for directional stability of the machine which may cause in an unacceptable deviation of the trajectory of the machine.

One more inherent disadvantage of conventional underground pneumopercussive hole making machines is lack of means or methods of retracting from the hole a machine by the help of another identical or similar machine in case of quitting of the air-distributing mechanism of the first machine due to a failure of a barb, hose, connector, etc.

The present invention eliminates all these disadvantages, offering a machine, characterized by significantly increased efficiency at lower complexity and manufacturing cost.

The new structural solution of the present invention is incorporated in many full scale prototypes that have been successfully tested in laboratory and field conditions. The results of the extensive testing of these prototypes confirm an essential improvement of their performance in comparison with the considered machine. In addition to this, the reliability of the prototypes is significantly increased while their manufacturing and maintenance cost is essentially reduced.

SUMMARY OF THE INVENTION

The invention offers a monotube differential pneumopercussive self-propelled reversible cyclic-action soil penetrating machine with directional stabilizers, which is characterized by essential improvement of the performance at reduced cost of manufacturing and maintenance. This is achieved in part by a new structural solution of the machine housing comprising just one tube carrying rigidly connected to it longitudinal stabilizers allowing for delivery and exhaust of compressed air. Depending on the number and positioning of the stabilizers, it is possible to achieve the directional stability of the trajectory of the machine in one (horizontal or vertical) or two (horizontal and vertical) planes.

A further aspect of the invention is associated with securing the air-distributing mechanism inside of the tubular housing by means of press fits and pins, which eliminate the need for the entire tail nut assembly.

Another aspect of the invention represents an essential simplification of the front anvil assembly by use of a flexible anvil, which reduces the impact forces applied to the threaded connection of this assembly.

Still another aspect of the invention is associated with an essential decrease of the overall weight of the housing and of the machine as a whole and also with a significant increase of the inside diameter of the housing for the same outside diameter in comparison with existing machines. This allows to increase the pressure force applied to the striker and also increase the mass of the striker and its impact energy at the same length of the stroke. All this significantly increase the efficiency of the transfer of the impact energy from the striker to the housing and finally results in a higher efficiency of the performance of the machine.

An additional feature of the invention relates to the development of means and a method of retracting from the hole a failed machine by the help of a similar or identical machine.

All these and other aspects of the invention will become apparent from the detailed description of the illustrated embodiment.

BRIEF DESCRIPTION OF THE DRAWING

The invention will be further described with reference to the accompanying drawing.

FIGS. 1*a*, 1*b*, and 1*c*, of which FIG. 1*b* is a continuation of FIG. 1*a*, and FIG. 1*c* is a continuation of FIG. 1*b*, represent a longitudinal sectional view of a monotube differential pneumopercussive self-propelled reversible soil penetrating machine with stabilizers according to the invention. The components of the machine are positioned for forward mode operation at the beginning of the forward stroke of the striker.

DESCRIPTION OF THE ILLUSTRATED EMBODIMENT

A. General Description

Figure 1A:
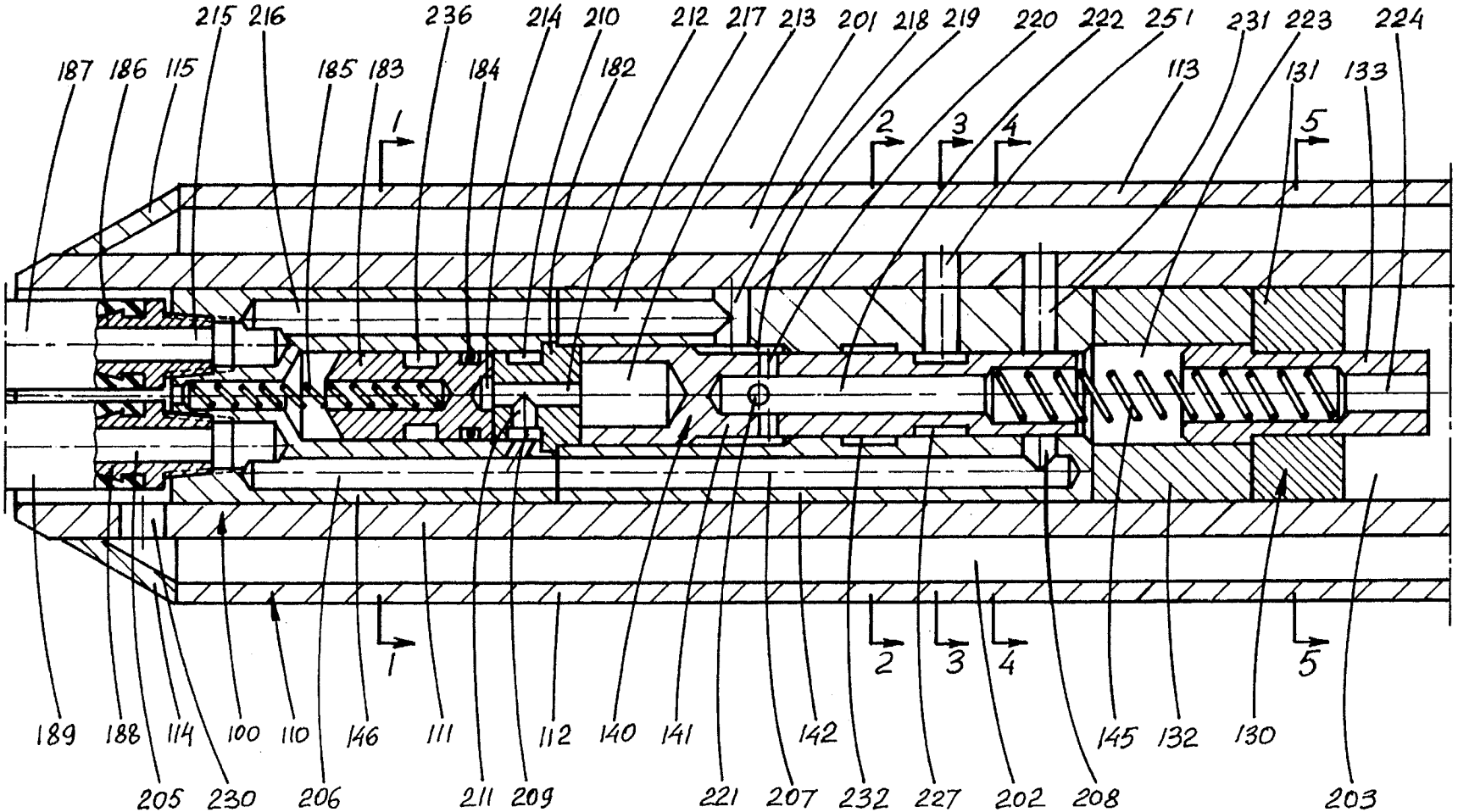
Figure 1B:
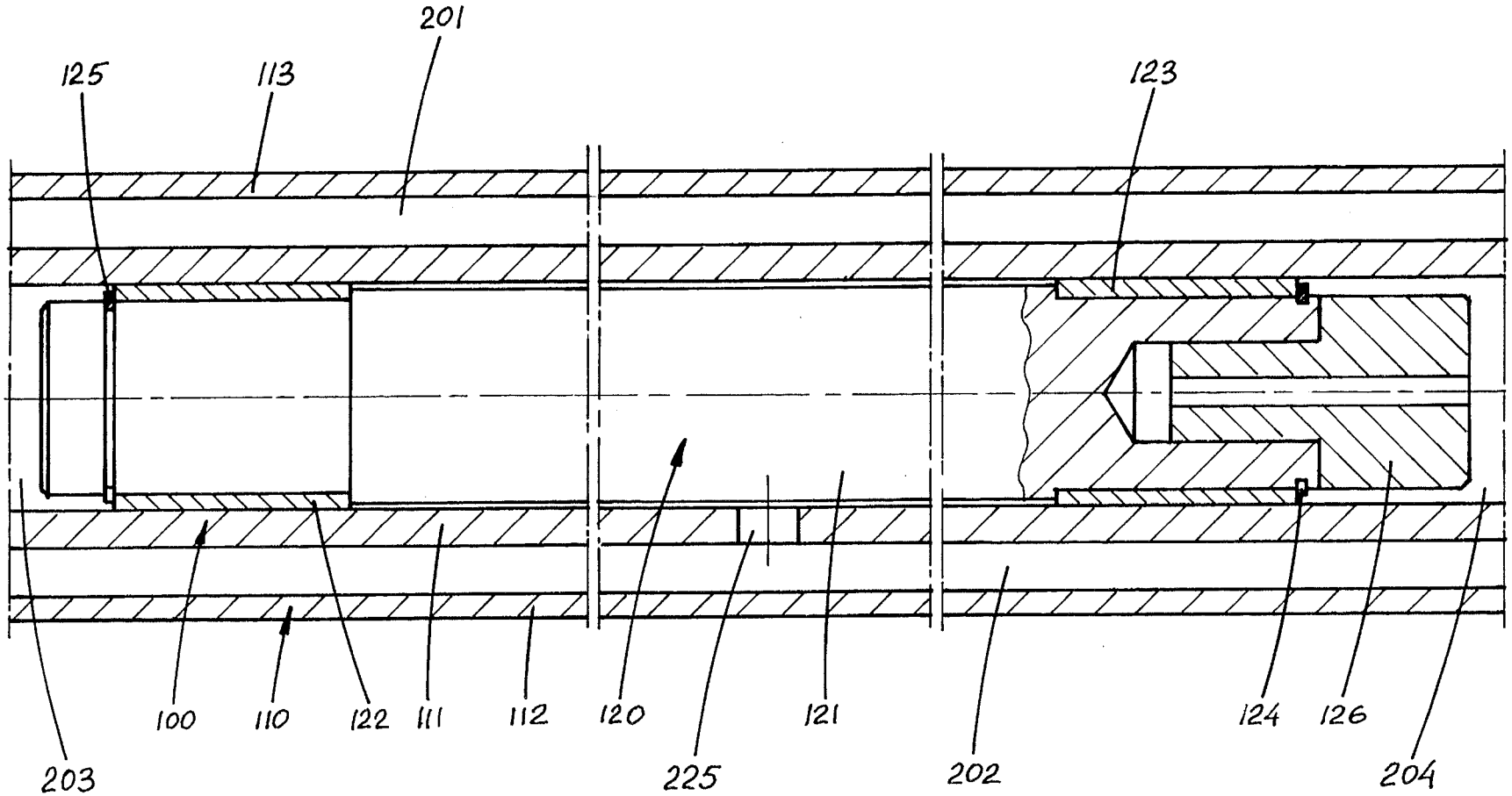
Figure 1C:
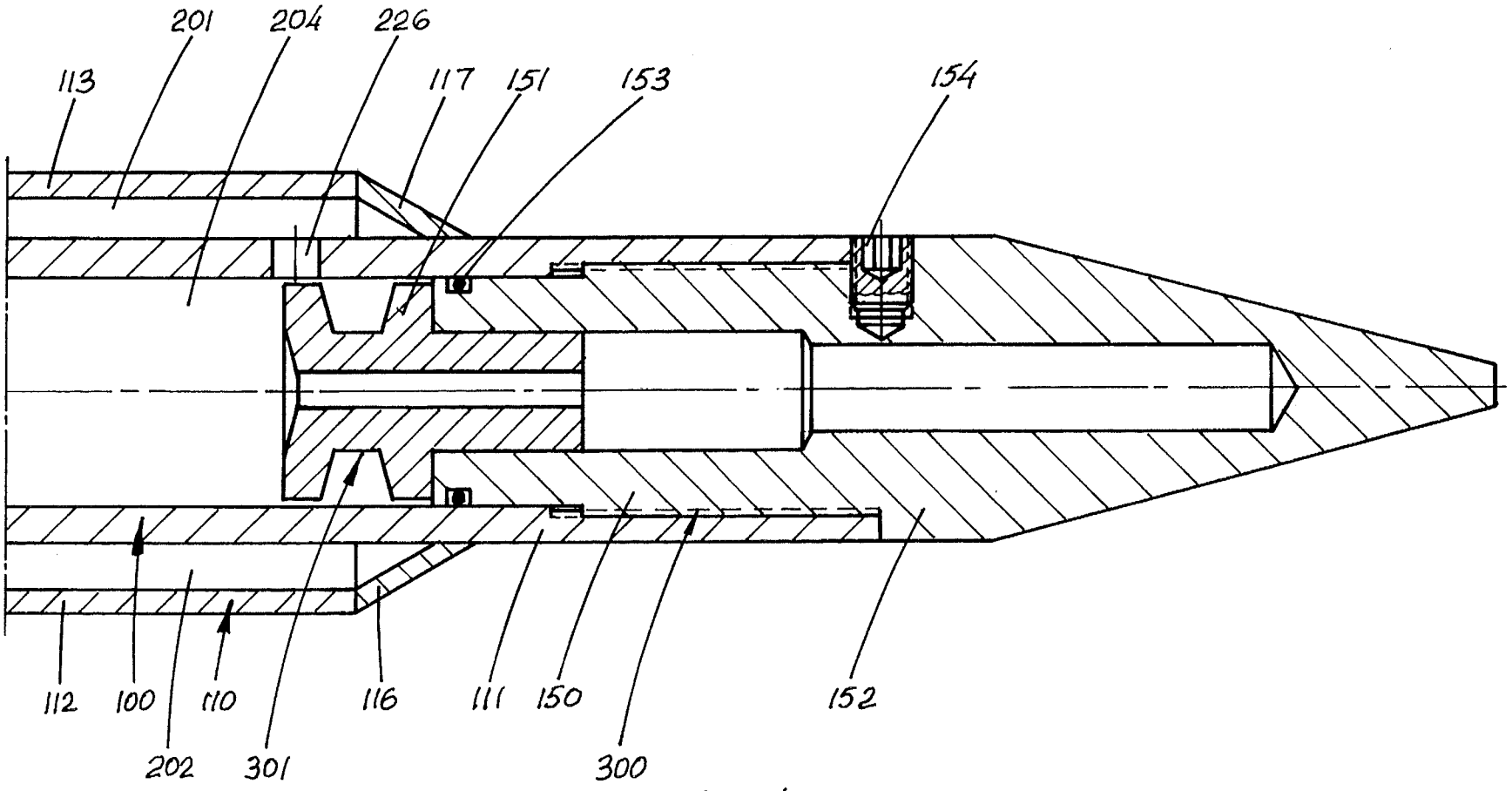
Figure 4:
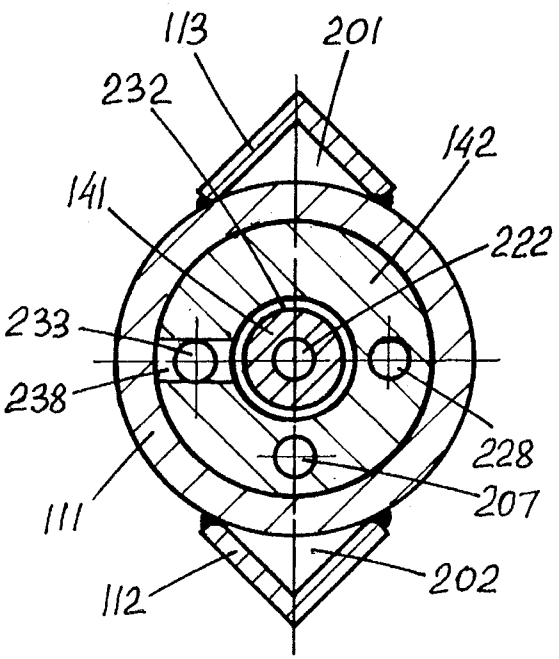
FIG. 4 is a cross-sectional view taken along the line 2—2 in FIG. 1*a*.

As shown in FIGS. 1*a*, 1*b*, and 1*c*, a monotube differential pneumopercussive reversible self-propelled soil penetration machine with stabilizers 100 according to the invention includes, as major assemblies, an elongated housing assembly 110, comprising a tube 111 and longitudinal stabilizers 112 and 113; a striker assembly 120 disposed for reciprocation within tube 111; a rear anvil assembly 130 rigidly secured to tube 111 rearwardly of striker assembly 120; a differential valve-operated air-distributing mechanism 140 secured in tube 111 rearwardly of rear anvil assembly 130 for supplying compressed air to reciprocate striker assembly 120; and a chisel assembly 150 rigidly secured to the front part of tube 111. Each of these assemblies will hereafter be described in detail.

Referring to FIGS. 1*a*, 1*b*, 1*c*, and 2–7, stabilizers 112 and 113 represent longitudinal structural angular shapes rigidly connected to the outer surface of tube 111, creating longitudinal channels 201 and 202 for delivery and exhaust of compressed air. Stabilizers 112 and 113 are hermetically plugged by suitable angular plugs 114, 115, 116, and 117.

As shown in FIG. 1*c*, chisel assembly 150 includes a front anvil 151, a chisel 152, an O-ring 153, and a set screw 154. Front anvil 151 is pressed into chisel 152 which is rigidly secured by a threaded connection 300 to the front part of tube 111. Set screw 154 is used to prevent loosening of threaded connection 300. Instead of a set screw, certain thread-locking fluids can be used. The bit of front anvil 151 has a trapezoidal grove 301 for increasing its flexibility during the collision with striker assembly 120 and, consequently, decreasing of the stresses in threaded connection 300. The desire flexibility of front anvil 151 can be obtained by choosing an appropriate ratio between the diameter and active length of a cylindrical bit (without any special grooves). An elastic O-ring 153 is used for hermetization of the connection of chisel 152 to tube 111.

Figure 7:
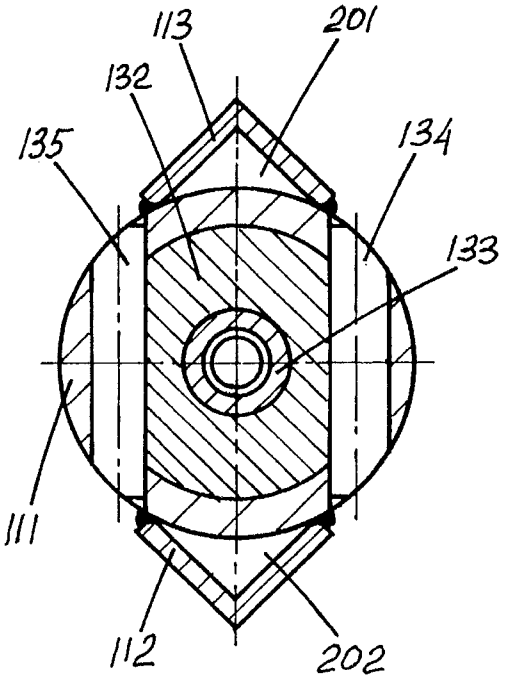
FIG. 7 is a cross-sectional view taken along the line 5—5 in FIG. 1*a*.
Figure 6:
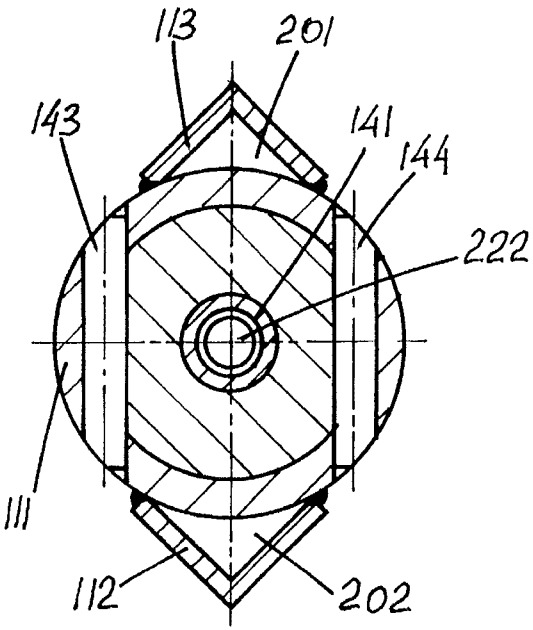
FIG. 6 is a cross-sectional view taken along the line 4—4 in FIG. 1*a*.
Figure 5:
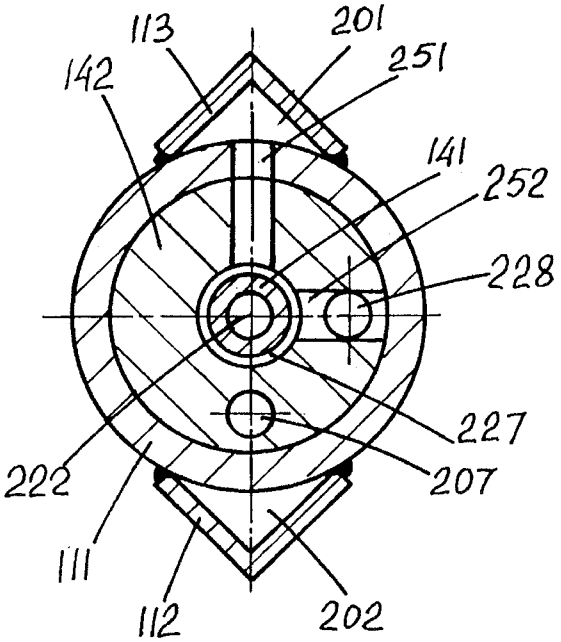
FIG. 5 is a cross-sectional view taken along the line 3—3 in FIG. 1*a*.
Figure 8:
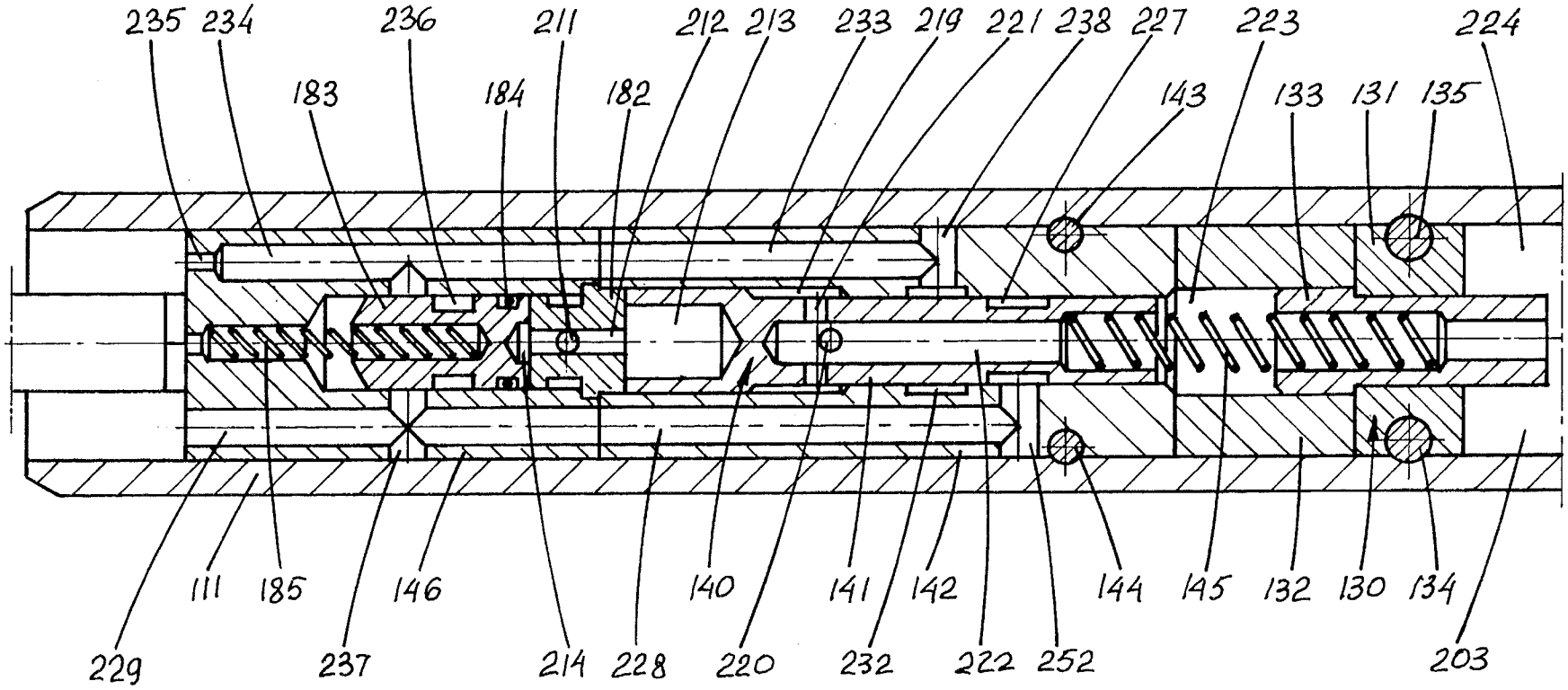
FIG. 8 is a revolved partial longitudinal sectional view along the line 6—6 in FIG. 2.

As FIGS. 1*a*, 7, and 8 illustrate, rear anvil assembly 130 includes a rear anvil 131, spacer 132, follower 133, and pins 134 and 135. Rear anvil 131 and also spacer 132 are pressed into tube 111. Pins 134 and 135 are used to increase the security of the connection between tube 111 and rear anvil 131. At an appropriate press fit between these two components, the pins are not needed. Rear anvil 131 and spacer 132 in some cases may be made as one component. Follower 133 is movably installed in spacer 132 and rear anvil 131.

Referring now to FIG. 1*b*, striker assembly 120 comprises a striker 121; a rear bushing 122 and a front bushing 123, made of low-friction material; a front bit 126, made of hard shock-proof material; and two retaining rings 124 and 125. Bushings 122 and 123 are held in place by retaining rings 124 and 125. Front bit 126 is pressed into the hole of striker 121. It should be noted that striker 121 and front bit 126 can be made as one piece using appropriate material and heat treatment. Striker assembly 120 is inserted into tube 111 through its front opening.

Referring to FIGS. 1*a*, 2–6, and 8, differential air-distributing mechanism 140 includes a spring loaded stepped stroke control spool valve 141; a front valve chest 142, accommodating stroke control valve 141 for reciprocation, and is assembled with tube 111 by a press fit and secured by pins 143 and 144; a stroke control spring 145, exerting outward thrust on stroke control valve 141 and follower 133; a rear valve chest 146, secured to front valve chest 142 by four bolts 147, 148, 149, and 181; a centering step-bushing 182, which is pressed into rear valve chest 146, and centering front valve chest 142 by a slide fit; a spring loaded relief valve 183 having a dynamic sealing O-ring 184; a spring 185 which is loading relief valve 183; a hose barb 186 with an air hose 187 for delivery of compressed air at the nominal (high) pressure from a source of compressed air; a hose barb 188 with an air hose 189 for delivery of compressed air at reduced (low) pressure from the source of compressed air through a conventional air pressure regulator (not shown in the drawing). Assembling of air-distributing mechanism 140 may be performed in the following order. Relief valve 183 with O-ring 184 and spring 185 are accommodated by rear valve chest 146 and then plugged by inserting against a stop centering step-bushing 182 into rear valve chest 146. Then barbs 186 and 187 together with hoses 187 and 189 are screwed into rear valve chest 146. After that, stepped stroke control valve 141 with spring 145 is inserted into front valve chest 142. Then, rear valve chest 146, being centered by step-bushing 182, is assembled with front valve chest 142 by four bolts 147, 148, 149 and 181. Follower 133, accommodating spring 145, is movably inserted into spacer 132 and rear anvil 131 before front valve chest 142 is pressed into tube 111.

Referring to FIGS. 1*a*, 1*b*, 1*c*, and 8, the inside space between the front end of rear anvil 131 and rear end of striker assembly 120 represents a forward stroke chamber 203. The inside space between the front end of striker assembly 120 and the rear end of front anvil 151 represents a backward stroke chamber 204.

Figure 9:
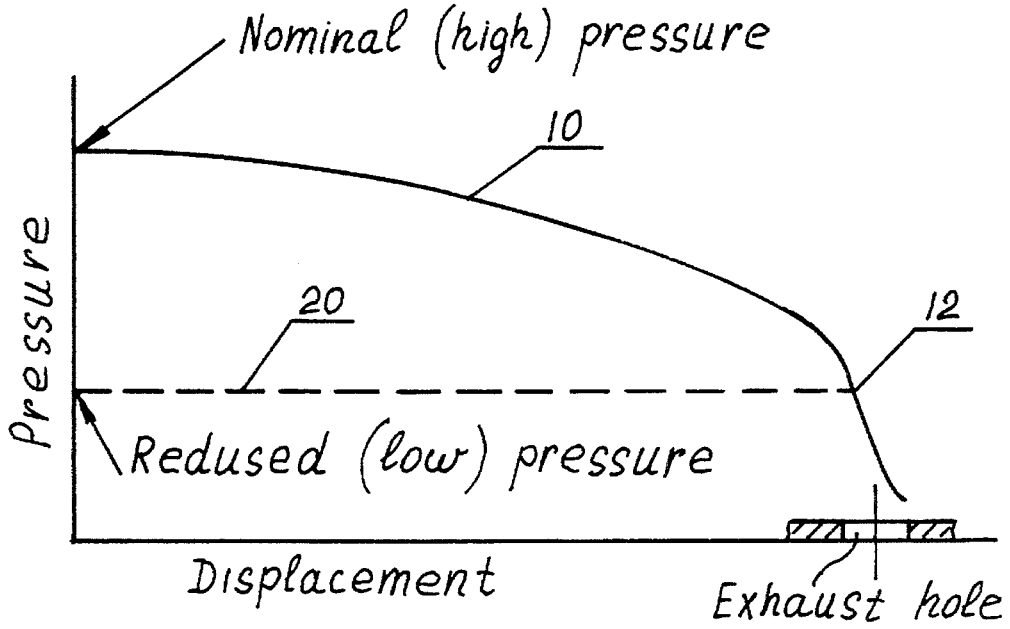
FIG. 9 represents graphs characterizing the air pressure applied to the right and left ends of the stroke control valve during the forward stroke of the striker in forward mode operation.
Figure 10:
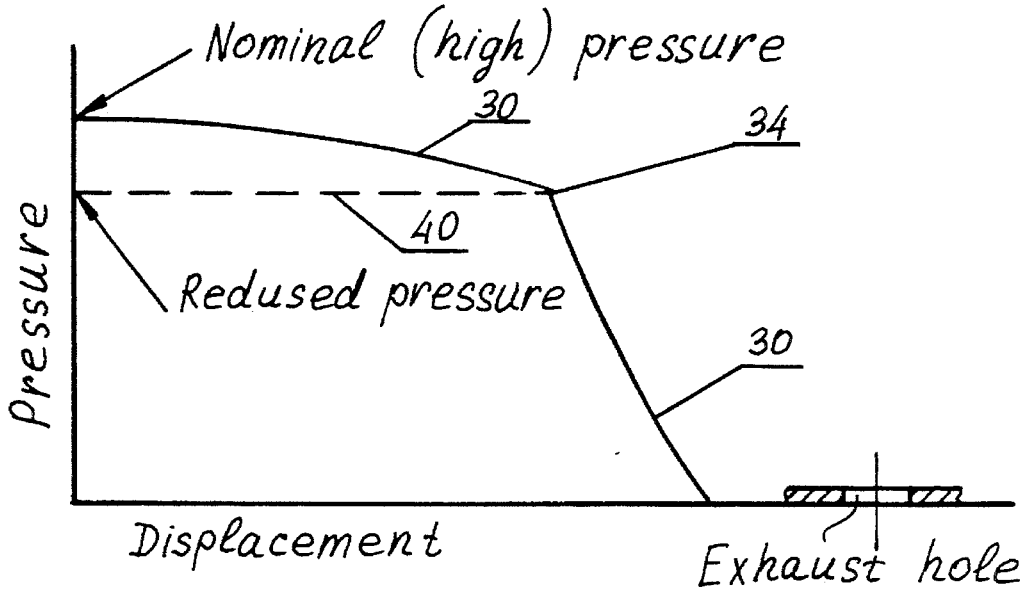
FIG. 10 represents graphs, characterizing the air pressure applied to the right and left ends of the stroke control valve during the forward stroke of the striker in reverse mode operation.

FIGS. 9 and 10 are related to air-distributing mechanism 140, functioning of which will be considered later.

FIGS. 11–22 illustrate accessories and some modifications of the components of machine 100 that are needed for retracting from the hole a failed machine (first machine) by a similar or identical machine (second machine) and also for expansion of the hole.

Figure 11:
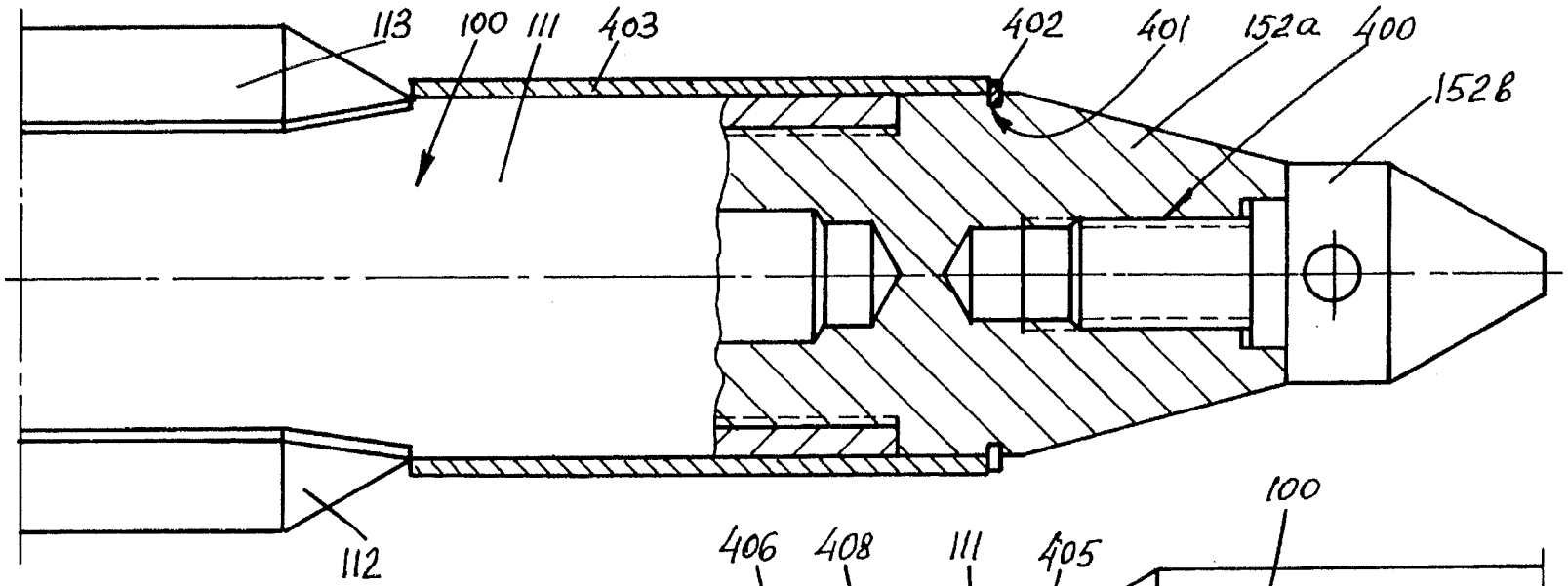
FIG. 11 is a partial longitudinal sectional view of the front part of the machine illustrating certain accessories and modifications of the chisel related to the method of retracting from the hole a failed machine by the help of an identical machine.

FIG. 11 shows the modifications of the front part of machine 100 and illustrates some of the associated accessories. Chisel 152 (FIG. 1*c*) is made of two components representing a chisel body 152*a* and a front bit 152*b* (FIG. 11) which are secured to each other by a threaded connection 400. Chisel body 152*a* has a groove 401 accommodating a retaining ring 402, which keeps in place a thin walled front expansion bushing 403 mounted by a slip fit on the front part of housing 111. In case of retracting the first machine, front bit 152*b* of the second machine should be replaced by a respective component of the pulling accessory.

Figure 12:
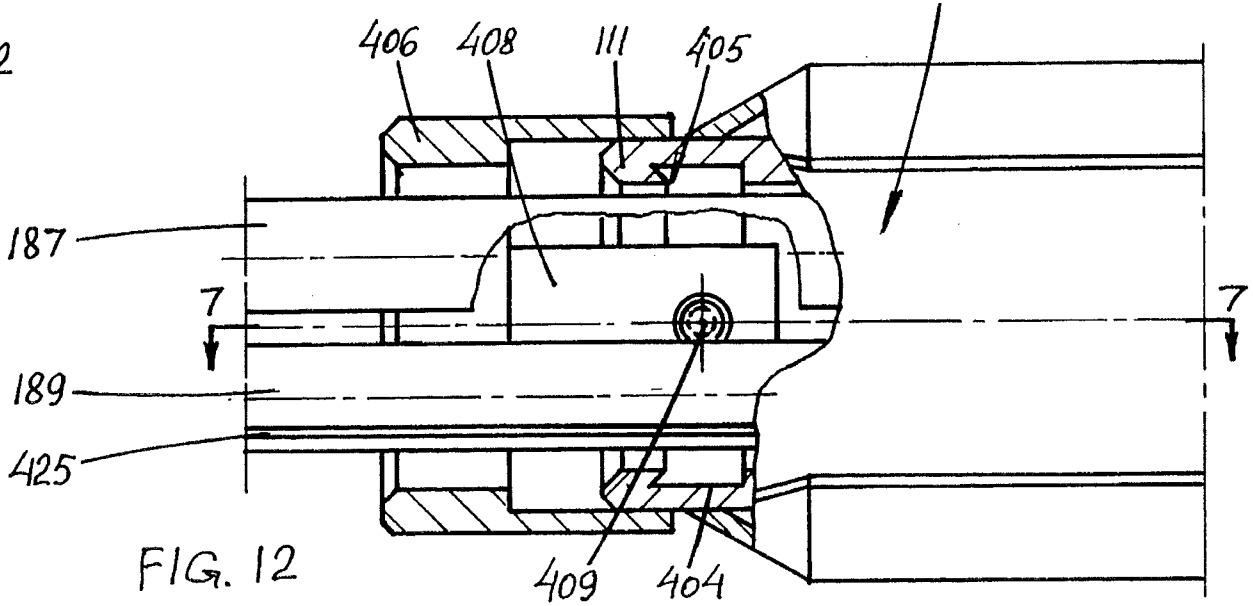
FIG. 12 is a partial longitudinal sectional view of the rear part of the machine illustrating certain accessories and modification of the rear part of the housing related to the method of retracting from the hole a failed machine by the help of an identical machine.
Figure 13:
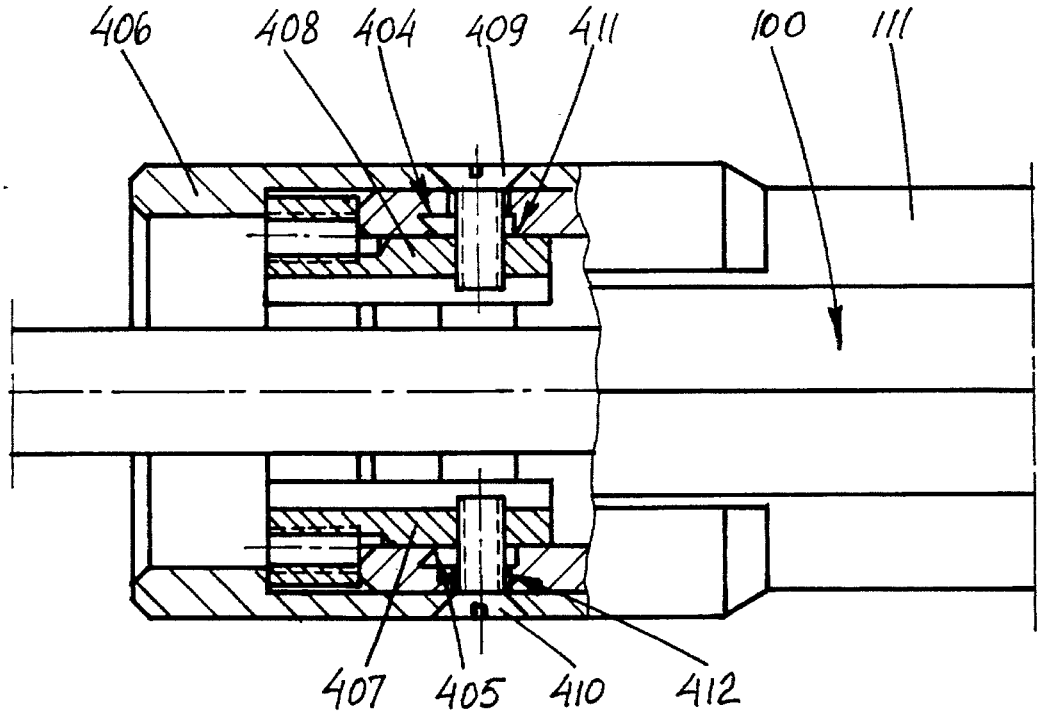
FIG. 13 is a partial longitudinal sectional view along the line 7—7 in FIG. 12.

FIG. 12 and 13 show the modifications of the rear part of machine 100 and illustrate some of the related accessories mounted on the second machine. A groove 404 with a reversed tapered wall 405 is made in the rear part of housing 111. A rear expansion bushing 406, having the same outside diameter as front expansion bushing 403, is mounted on the rear part of housing 111 and secured to two inserts 407 and 408 by means of screws 409 and 410 which pass through holes 411 and 412 in housing 111.

Figure 14:
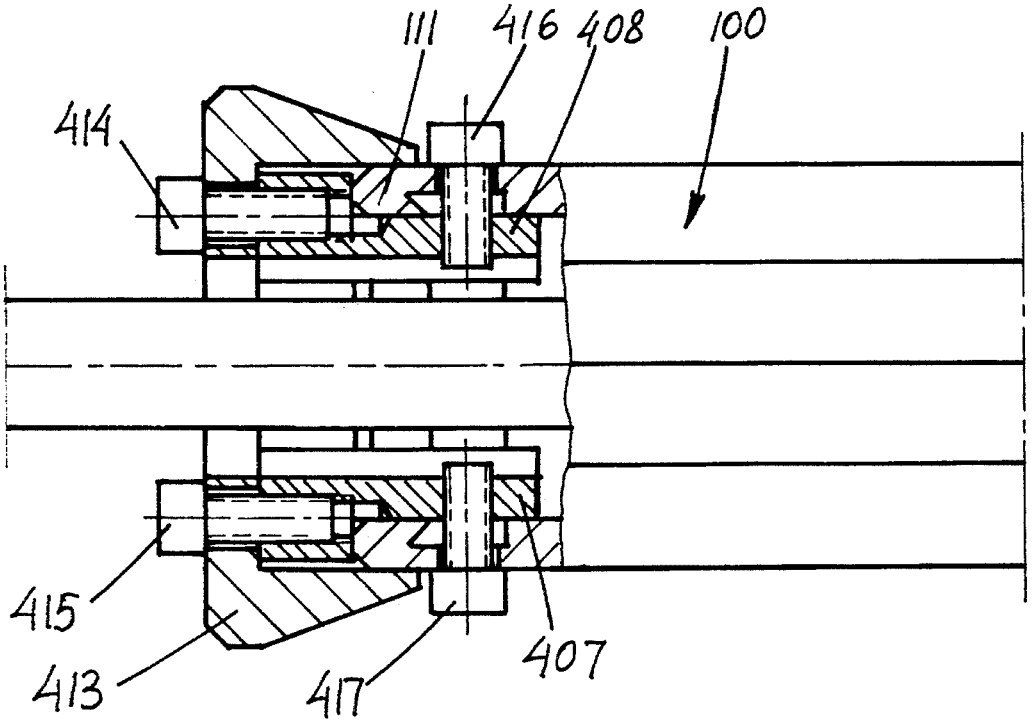
FIG. 14 is a partial longitudinal sectional view of the rear part of the machine, illustrating certain accessories and modifications related to the expansion of the hole.

Referring now to FIG. 14, an expander 413, mounted on the rear part of housing 111, is secured to the same inserts 407 and 408 by means of bolts 414 and 415. The inserts 407 and 408 are rigidly connected to housing 111 by the help of bolts 416 and 417.

Figure 15:
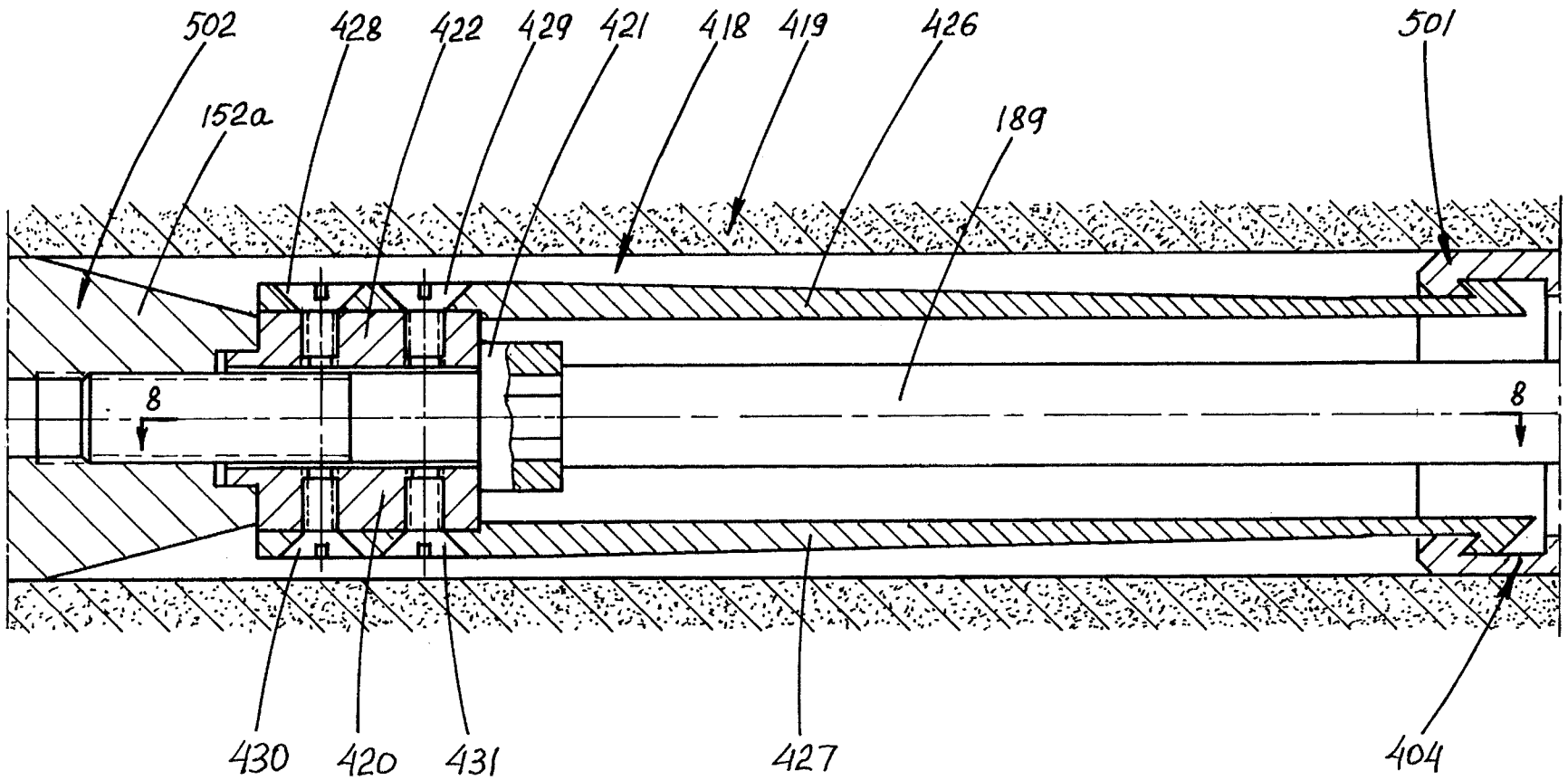
FIG. 15 is a partial longitudinal sectional view of a pair of machines, located in the hole, illustrating the interaction between the accessories and machines related to the method of retracting from the hole a failed machine (in the right) by the help of an identical machine (in the left).
Figure 16:
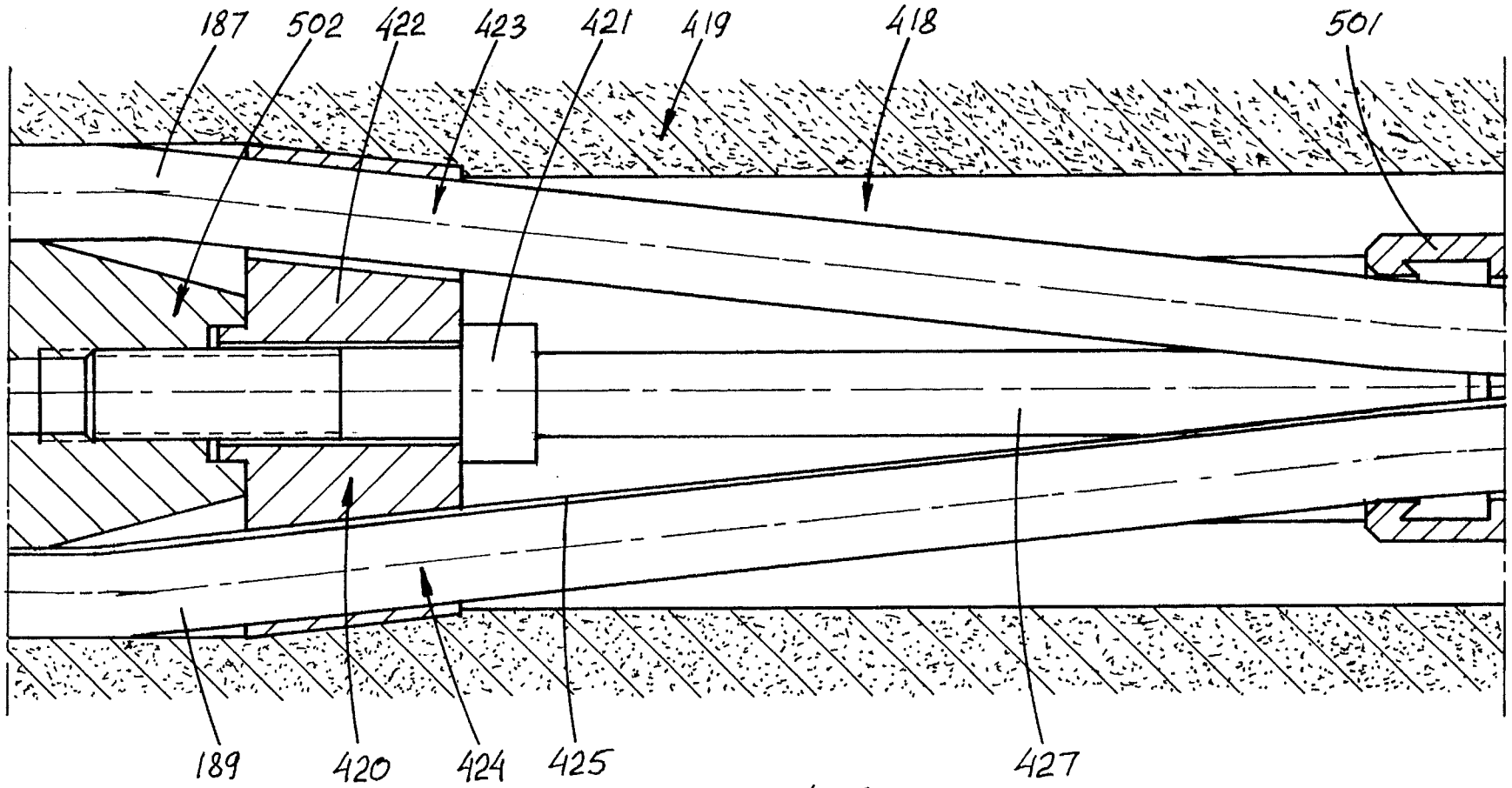
FIG. 16 is a partial longitudinal sectional view along the line 8—8 in FIG. 15.

FIGS. 15 and 16 illustrate the method of retracting from a hole 418 in soil 419 a failed machine (first machine) 501 by an identical machine (second machine) 502. In this case, expansion bushings 403 and 406 are not used. The use of them is recommended for heavy soil conditions in order to reduce the skin friction forces on the first machine. A pulling accessory 420 is mounted on chisel body 152*a* and secured by a bolt 421. Pulling accessory 420 comprises a puller body 422, having inclined holes 423 and 424 for accommodating hoses 187 and 189 and electric wire 425 of machine 501, pullers 426 and 427 rigidly connected to puller body 422 by screws 428, 429, 430, and 431. As shown in FIG. 15, pullers 426 and 427 are engaged in groove 404 providing the possibility to retract machine 501 by machine 502.

Figure 17:
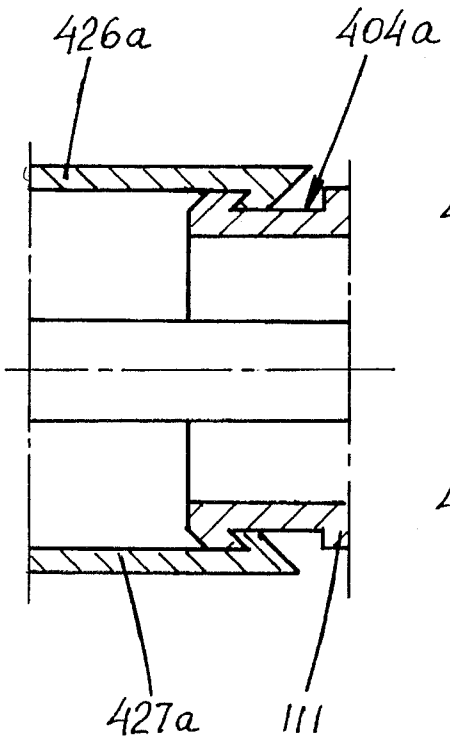
FIG. 17 is a partial longitudinal sectional view of the rear part of the machine, illustrating an outside engagement related to the method of retracting a failed machine.

FIG. 17 represents an outside type of engagement of pullers 426*a* and 427*a* to an outside groove 404*a* on the rear part of housing 111.

Figure 18:
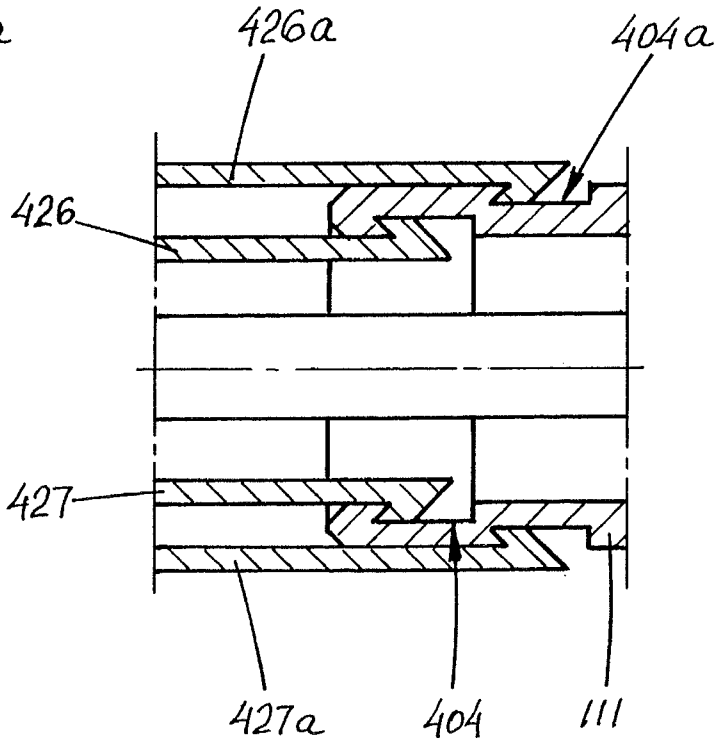
FIG. 18 is a partial longitudinal sectional view of the rear part of the machine, illustrating a double engagement related to the method of retracting a failed machine.

FIG. 18 represents a double engagement of two sets of pullers 426 and 427, and 426*a* and 427*a*, using inside groove 404 and outside groove 404*a* respectively.

Figure 19:
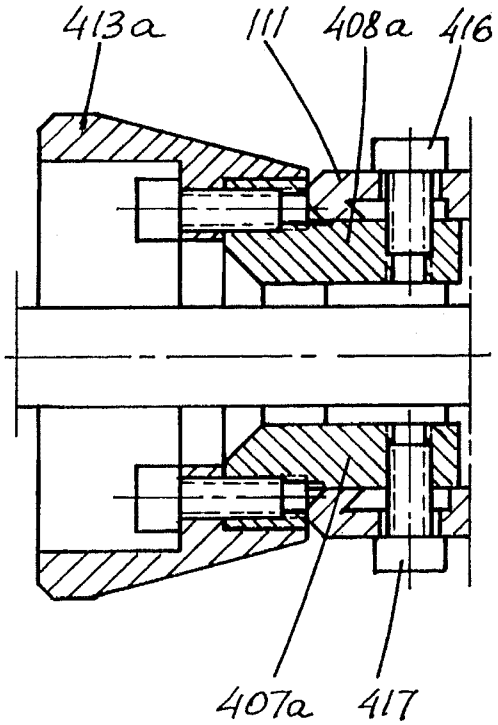
FIG. 19 is a partial longitudinal sectional view of the rear part of the machine, illustrating some alternative accessories related to the expansion of the hole.

FIG. 19 illustrates an alternative mounting of an expander 413*a* on a different set of inserts 407*a* and 408*a*, rigidly secured to the rear part of housing 111 by bolts 416 and 417. Expander 413*a* is secured to inserts 407*a* and 408*a* by bolts 414 and 415.

Figure 21:
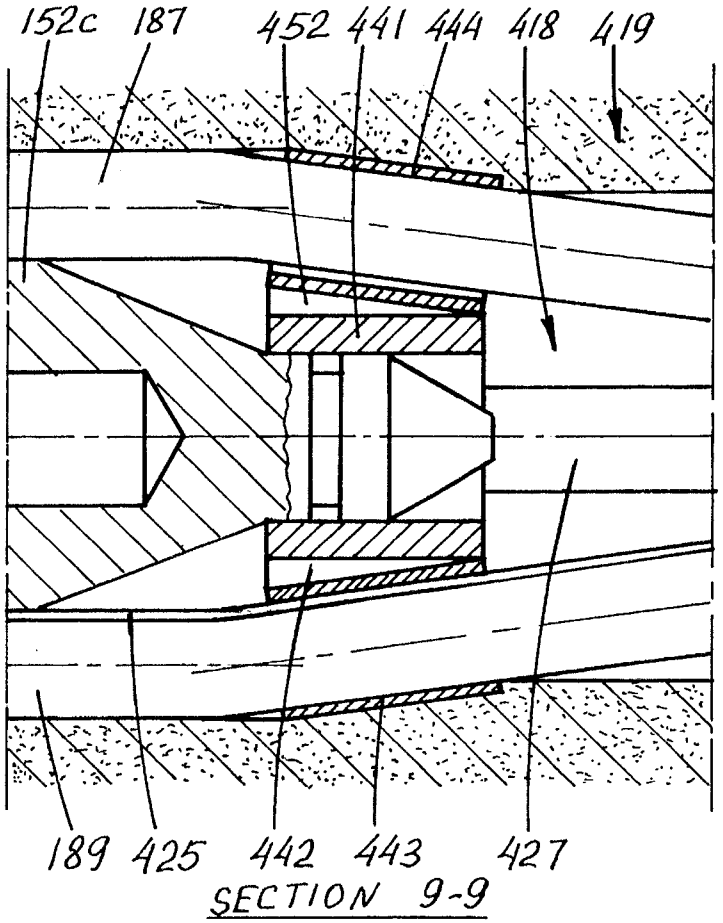
FIG. 21 is a partial longitudinal sectional view along the line 9—9 in FIG. 20.
Figure 20:
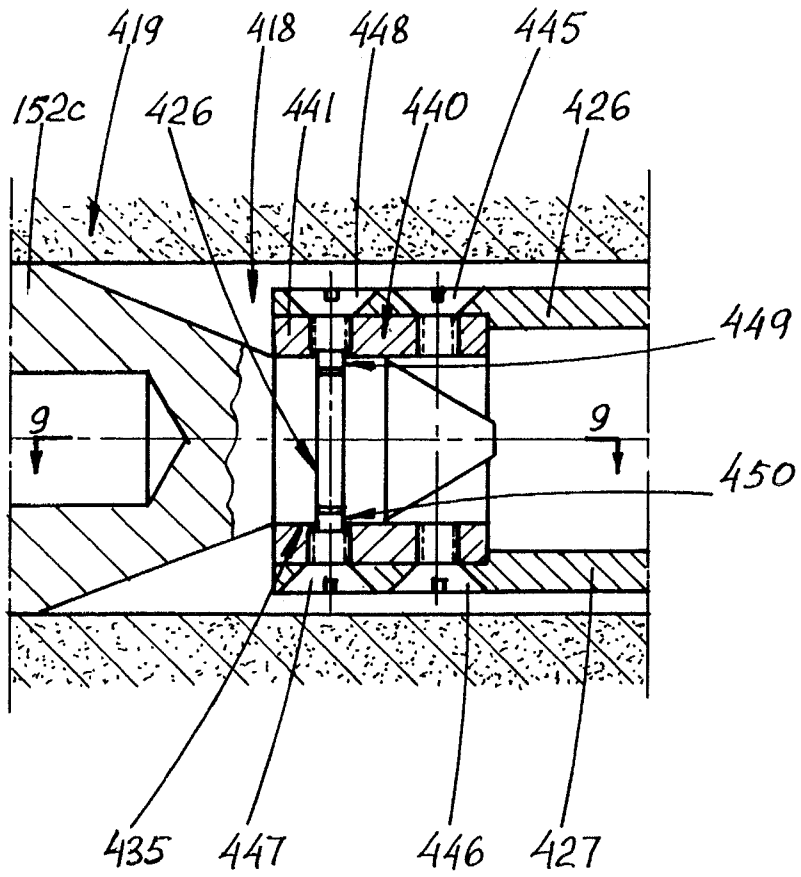
FIG. 20 is a partial longitudinal sectional view of the front part of the machine, illustrating an alternative connection of the accessories to the chisel related to the retracting of the failed machine.

FIGS. 20 and 21 represent an alternative version of the modification of chisel 152 (FIG. 1*c*) and show and illustrate a related pulling accessory. A stepped chisel 152*c* has a cylindrical part 435 with a groove 436, accommodating with a slip fit a pulling accessory 440. Pulling accessory 440 comprises a pulling body 441 with welded to it ribs 442 and 452 and inclined pipes 443 and 444. Pullers 426 and 427 are rigidly connected to puller body by screws 445, 446, 447, and 448. Screws 447 and 448 have cylindrical tails that fit with a gap into groove 436. Pipes 443 and 444 accommodate hoses 187 and 189 and also wire 425.

Figure 22:
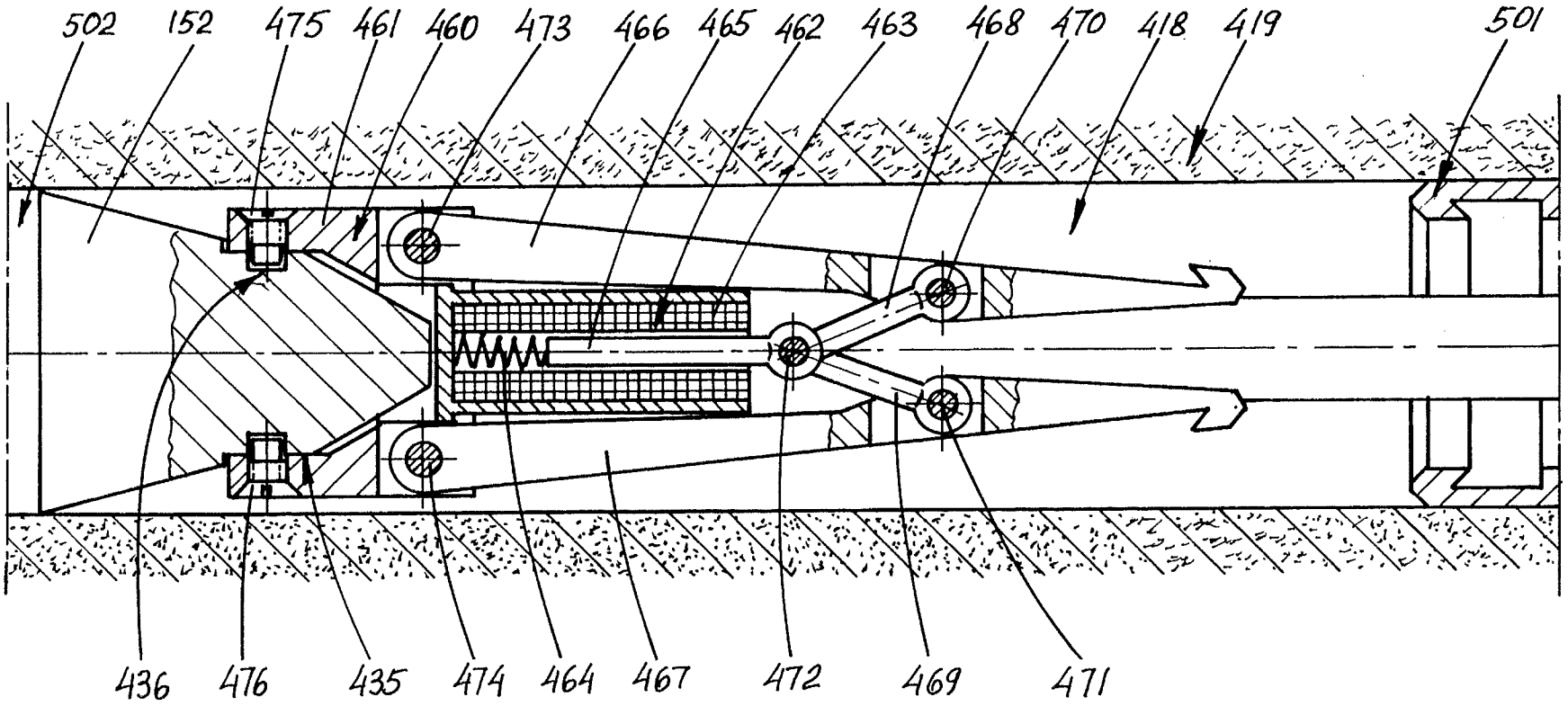
FIG. 22 is a partial longitudinal sectional view of a pair of machines, located in the hole, illustrating alternative accessories related to the method of retracting a failed machine.

FIG. 22 illustrates a controlled type of a pulling accessory 460, comprising a puller body 461 with welded to it ribs and inclined pipes (not shown), similar to pulling accessory 440 (FIG. 21); solenoid assembly 462 including a solenoid 463 with wires (not shown), a spring 464, and a spring loaded follower 465; pullers 466 and 467; connecting rods 468 and 469; pins 470, 471, 472, 473, and 474; and screws 475 and 476. Puller body 461 is mounted with a slip fit on cylindrical part 435 of chisel 152*c* and secured in the longitudinal direction by the cylindrical tails of screws 475 and 476 which are accommodated by groove 436 on chisel 152*c*.

B. MACHINE OPERATION

The Differential Air-Distributing Mechanism described in the U.S. Pat. No. 5,311,950 is incorporated in the present invention with a little modification, and in order to explain the machine operation, FIGS. 9 and 10, representing the relationship between air pressure inside forward stroke chamber 203 and displacement of striker 120 as well as some related descriptions are adopted from this patent. The above mentioned modification relates to the elimination of the exhaust hole in backward stroke chamber 204. In this case, machine 100 will operate even at a relatively very low pressure in the reduced (low) air pressure line, which improves the starting features and the overall performance of the machine especially for vertical hole making. This will become apparent during the description of the machine operation.

B.1. Forward Mode Operation

All the components in the drawing are shown in the position at which striker 120 performs the forward stroke in forward mode operation.

The air pressure in the nominal (high) pressure line is 100 psi (the conventional pressure of industrial compressors). For this nominal pressure the air pressure in the reduced (low) pressure line for forward mode operation should be adjusted to 40–45 psi by means of a conventional pressure regulator. It is obvious that the machine will work at different combinations of high and low pressure lines.

Figure 3:
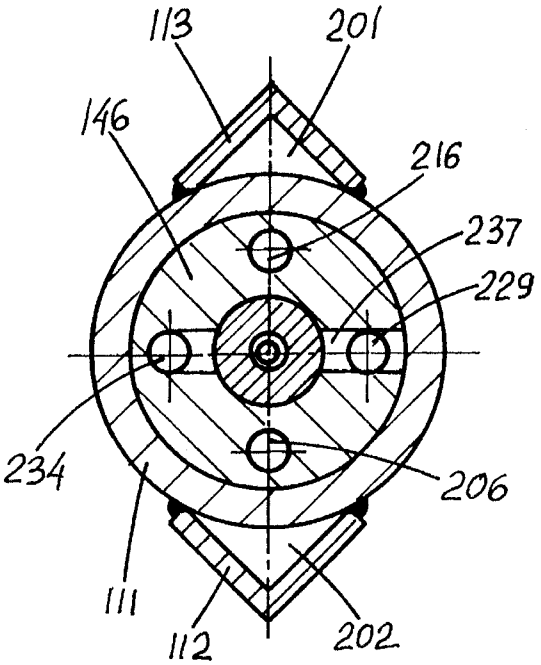
FIG. 3 is a cross-sectional view taken along the line 1—1 in FIG. 1*a*.

Before the start of machine 100, hoses 187 and 189 are depressurized, stroke control valve 141 is moved by spring 145 to the extreme left position, and follower 133 is moved by the same spring to the extreme right position. Striker 120 may be located in any position between rear anvil 131 and front anvil 151. In order to start machine 100, the valves of nominal (high) pressure hose 187 and reduced (low) pressure 189 may be open simultaneously or in any order. For the tested prototypes during forward mode operation the nominal (high) pressure was 100 psi while the reduced (low) pressure was in the range of 40–45 psi. Consider, for instance, a case when both hoses are pressurized simultaneously and striker 120 is located close to rear anvil 131. The compressed air of reduced (low) pressure will flow from hose 189 into two directions. One of them is through longitudinal holes 205, 206, and 207 to a radial hole 208, which is overlapped by stroke control valve 141 (FIGS. 1*a*, 3, 4, and 5). The second direction for the reduced (low) pressure air is from hole 206 through an inclined duct 209, an annular space 210 and a radial hole 211 into a longitudinal hole 212, and from there into cavities 213 and 214 (FIGS. 1*a* and 3). The compressed air of nominal (high) pressure from hose 187 through longitudinal holes 215, 216, 217, and a duct 218 will enter into an annular space 219, and from there through radial holes 220 and 221, longitudinal holes 222, 223, and 224 into forward stroke chamber 203, pushing striker 120 forward (FIGS. 1*a*, 3, 4, 5, 6, and 8). Spring 185 of relief valve 183 is compressed to an extent that relief valve 183 remains in its extreme right position in spite of the action of the reduced (low) pressure compressed air in cavity 214. The reduced (low) pressure compressed air, acting in cavity 213, is trying to push stroke control valve 141 to the right. However, the nominal (high) pressure air is pushing the valve to the left. The relationship between air pressure inside forward stroke chamber 203 and the displacement of striker 120 during its forward stroke at forward mode operation of machine 100 is represented by curve 10 in FIG. 9. Curve 10 shows that the air pressure begins to drop essentially from its nominal (high) value shortly after striker 120 starts to move forward. When the rear end of striker 120 opens an exhaust hole 225 (FIG. 1*b*), the pressure in forward stroke chamber 203 drops according the abrupt part of curve 10. The air pressure, reflected by curve 10, together with spring 145 are pushing stroke control valve 141 to the left. The value of the reduced (low) air pressure adjustable by a conventional pressure regulator, applied all the times at forward mode operation during the forward and backward strokes of striker 120 to the left end of stroke control valve 141 is represented by a dotted line 20 in FIG. 9. Thus, a pressure force, corresponding to the reduced (low) air pressure and directed to the right, is permanently applied to the left end of stroke control valve 141. As it is illustrated in FIG. 9, most of the time during the forward stroke of striker 120 the air pressure value inside forward stroke chamber 203 significantly exceeds the value of the reduced (low) air pressure. Thus, a pressure force, corresponding to the nominal (high) air pressure and directed to the left, is applied to the right end of stroke control valve 141. The difference of these forces results in a force directed to the left most of the time during the forward stroke of striker 120 (not counting spring 145) and holds stroke control valve 141 in its extreme left position. In this case, compressed air will flow into forward stroke chamber 203, accelerating striker 120 during its entire forward stroke, while backward stroke chamber 204 will be connected to the atmosphere through a radial hole 226, channel 201, a radial hole 251, an annular space 227, a radial hole 252, and longitudinal holes 228 and 229 (FIGS. 1*a*, 1*c*, 2, 3, 4, 5, 6, 7, and 8). At this time the reduced (low) air pressure line will be trapped. When striker 120, almost at the end of its forward stroke, opens an exhaust hole 225 (FIGS. 1*b* and 9), forward stroke chamber 203 will be connected to the atmosphere through channel 202 and radial hole 230. Striker 120 will continue to move forward and will impart an impact to front anvil 151, causing an incremental penetration of machine 100 into the soil. At this time the pressure inside forward stroke chamber 203 will drop below point 12 (FIG. 9). This enables the reduced (low) air pressure to move stroke control valve 141 to its extreme right position, at which the compressed air at the reduced (low) pressure will flow through radial hole 208, annular space 227, radial hole 231, channel 201, and radial hole 226 into backward stroke chamber 204, enabling striker 120 to perform its backward stroke, while the nominal (high) air pressure line is trapped, and forward stroke chamber 203 is connected to the atmosphere through longitudinal holes 224, 223,222, radial holes 221 and 220, annular space 232, longitudinal holes 233 and 234, and calibrated orifice 235 (FIG. 8) which creates an air buffer braking to some extent striker 120 during its backward stroke. Since there is no special exhaust hole in backward stroke chamber 204 striker 120 will move backward at a relatively very low pressure in this chamber. At the end of the backward stroke, striker 120 pushes follower 133 to the left and imparts a slight impact to rear anvil 131. Follower 131 in its turn pushes stroke control valve 141 to the left, the reduced (low) pressure line becomes to be trapped, the nominal (high) pressure compressed air starts to flow into forward stroke chamber 203, and striker 120 begins the forward stroke, and the cycle repeats itself.

B.2. Reverse Mode Operation

In order to switch over machine 100 from forward mode operation to reverse mode operation, it is necessary to increase the pressure in the reduced (low) air pressure line to a certain level, while the machine is working or not working. For the nominal (high) pressure of 100 psi the best performance of the tested prototypes for reverse mode operation was obtained at 75–80 psi. The air pressure in the reduced (low) pressure line or in both lines can be adjusted during the reverse mode operation by means of conventional pressure regulators. When machine 100 begins to intensively move backward, the reduced air pressure is adjusted properly. There is no need to stop machine 100 in order to switch over from forward stroke operation to reverse mode operation and vice versa. All air passages are used the same way for forward and reverse mode operation. The only difference is associated with relief valve 183, which will be pushed to its extreme left position by the increased pressure in the reduced (low) pressure air line (the reduced air pressure should be about 75–80 psi). In this case, as it can be seen in FIGS. 1*a*, 3, and 8, an annular space 236 is connected with a radial hole 237, which in its turn is connected with longitudinal hole 229, which is always connected with the atmosphere. Thus, when relief valve 183 is in its extreme left position, an additional passage is connecting forward stroke chamber 203 with the atmosphere during backward stroke of striker 120 in order to eliminate the restriction of the motion of striker 120 caused by calibrated orifice 235. At this condition, striker 120 will be intensively accelerated during its backward stroke, maintaining relatively high impact energy, which results in relatively high efficiency performance of machine 100 during reverse mode operation.

The relationship between air pressure inside forward stroke chamber 203 and displacement of striker 120 during its forward stroke at reverse mode operation of machine 100 is presented by curve 30 in FIG. 10. The value of the reduced air pressure applied at all times to the left end of stroke control valve 141 at reverse mode operation is reflected by a dotted line 40 in FIG. 10. As it can be seen by comparing FIGS. 9 and 10, the value of the reduced air pressure at reverse mode operation essentially exceeds the value of reduced (low) pressure at forward mode operation. It is obvious that stroke control valve 141 will be held in its extreme left position until the pressure inside forward stroke chamber 203 will be above the level of point 34 (FIG. 10). When the pressure inside forward stroke chamber 203 drops below the level of point 34, the reduced air pressure becomes sufficient enough to move stroke control valve 141 to its extreme right position. As shown in FIG. 10, this happens when striker 120 is still far away from front anvil 151 (FIG. 1*c*). Now the compressed air at reduced pressure is flowing through longitudinal holes 205, 206, 207, radial hole 208, annular space 227, radial hole 231, channel 201, and radial hole 226 into backward stroke chamber 204 intensively braking striker 120. The nominal (high) pressure line is trapped now, and forward stroke chamber 203 is connected to the atmosphere through longitudinal holes 224, 223, 222, radial holes 221 and 220, annular space 232, radial hole 238, longitudinal holes 233, 234, and calibrated orifice 235, and also through radial hole 237 and longitudinal hole 229 (FIGS. 1*a*, 1*c*, 3, 4, and 8). The value of the reduced pressure for reverse mode operation should be properly adjusted by the pressure regulator so that striker 120 would stop before reaching front anvil 151 (light impacts to front anvil 151 are allowed). After its stop, striker 120 begins its backward stroke being accelerated by the reduced air pressure flow. At the end of its backward stroke striker 120 pushes follower 133 to the left, which in its turn pushes stroke control valve 141 to the left, and striker 120 imparts an impact to rear anvil 151. Stroke control valve 141 moves to its extreme left position and the forward stroke of striker 120 begins.

C. DIRECTION STABILIZING

One of the important problems related to underground hole making technology is associated with stabilizing the trajectory of the self-propelled soil penetrating machine. Longitudinal structural shapes attached to the tubular housing of the machine will increase the soil resistance to the deviation of the machine from its trajectory. In the trenchless technology, the most essential requirement to the direction of the hole is to minimize the deviation from the horizontal plane. This is achieved in the present invention by welding two angular longitudinal stabilizers 111 and 112 to housing 101. Orienting stabilizers in the horizontal or vertical plane will improve the trajectory stability in the horizontal or vertical planes respectively. It is obvious that the number of longitudinal stabilizers is not limited to two. Also it is obvious that the shape of the stabilizers is not limited to the angular shape.

D. RETRACTING A FAILED MACHINE

It happens that a machine located in an underground hole stops to operate due to a failed hose or another reason. The existing self-propelled underground hole making machines do not have any means or method to retract the failed machine from the hole (Without digging a trench). There were attempts to retract a failed machine by attaching a cable to it and using a towing winch. However, if the direction of the hole is curved, the pulling cable cuts the soil to position itself along a straight line between the winch and the rear part of the machine. In this case, the machine should be tilted in the soil, which exerts tremendous resistance forces that usually cannot be overcame by a towing winch. Actually, this was the main reason to add the reverse mode operation to the underground self-propelled machines. The present invention offers a method and means to retract from the hole a failed machine by the help of a similar or identical machine.

As it is shown in FIGS. 11–13, 15–18, and 20–22, the rear part of the machine should have means for engaging a pulling accessory, while the front part of the machine should have means to accommodate the puller accessory and means for letting the hoses and the wire of the failed machine to pass. The method of retracting a failed machine 501 by a similar or identical machine 502 consists in the following.

Figure 2:
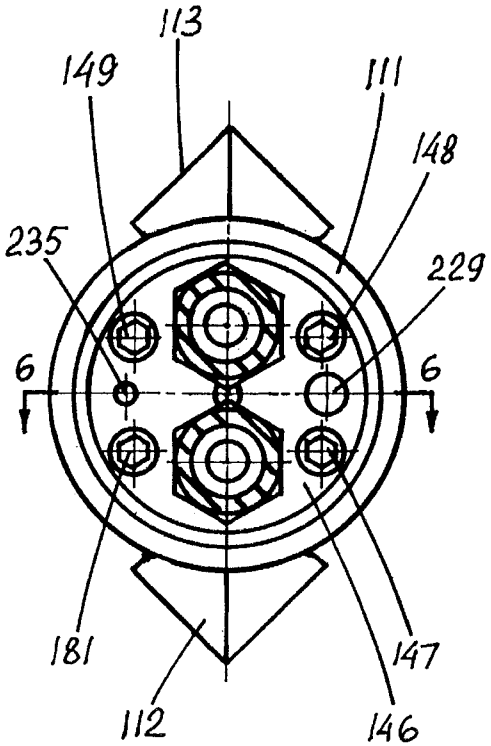
FIG. 2 is a left side view of the machine.

FIGS. 15 and 16 illustrate a possible version of retracting a failed machine by the help of an identical machine without using expansion bushings 403 and 406 shown in FIGS. 11 and 12. Expansion bushings 403 and 406 should be used in heavy soil conditions in order to reduce skin friction on machine 501. All machines should have an electric wire 425 connected to rear valve chest 146 of the machine and be attached to one of the hoses of the machine (FIGS. 12, 16, and 21). The second end of wire 425 should be attached to the control board (not shown). Usually, stabilizers 112 and 113 of the machine will be oriented in the horizontal plane and, as it is seen in FIGS. 1*a* and 2, hoses 187 and 189 will be also oriented in the horizontal plane. Stabilizers 112 and 113 will deform the soil 419 creating two channels along the walls of a hole 418. In case when a machine fails (machine 501), pulling accessory 420 should be mounted on chisel body 152*a* of the retracting machine (machine 502). Electric wires 425 of machines 501 and 502 should be connected to a source of current through a warning bulb. Hoses 187 and 189 with wire 425 of machine 501 should be fed through inclined holes 423 and 424 of puller body 422 (prior to that, the hose connectors should be removed). Holes 423 and 424 should be oriented in the horizontal plane (same plane, in which stabilizers 112 and 113 and also hoses 187 and 189 of machine 501 are oriented). Machine 502 should be installed in the beginning of hole 418, having its stabilizers oriented in the vertical plane. The stabilizers plane of the retracting machine should be always oriented perpendicularly to the stabilizers plane of the failed machine. Hoses 187 and 189 of machine 501 should be kept in tension during the retraction process. Machine 502 is adjusted to forward mode operation. Now machine 502 should be started, and it begins to penetrate into hole 418 made by machine 501. It should be noted that there is no reason for machine 502 to deviate from hole 418. When pullers 426 and 427 touch the rear part of machine 501, the warning bulb (not shown) comes on. Machine 502 should continue to move forward for about one half of an inch and then should be switched over to reverse mode operation. Pullers 426 and 427 are made of spring steel and they will be elastically bent passing through the rear opening of machine 501 and then pullers 426 and 427 will be straighten itself and become engaged with machine 501. If after a while of reversing machine 502 the warning bulb is off, it means that pullers 426 and 427 are disengaged from machine 501. In this case machine 502 should be switched over to forward mode operation to repeat the engagement procedures consisting of watching the warning bulb coming on and letting machine 502 move forward for about a half of an inch and then switching over machine 502 to reverse mode operation. The warning bulb should be on all the time of retracting machine 501 by machine 502. When machine 501 is completely retracted from hole 418 pullers 426 and 427 should be manually disengaged from machine 501.

FIGS. 20 and 21 illustrate an alternative pulling accessory 440 which is slidably mounted on cylindrical part 435 of chisel 152*c*. Screws 447 and 448 being engaged in groove 426 prevent the axial displacement of pulling accessory 440.

FIG. 22 represents pulling accessory 460 with electrically controlled operation of pullers 466 and 467. In this case, when machine 502 is penetrating into hole 418, solenoid assembly 462 is switched on and follower 465 is pulled into solenoid 463 compressing spring 464 and closing pullers 466 and 467. When pullers 466 and 467 touch the rear part of machine 501 the warning bulb becomes on, solenoid 463 should be switched off, spring 464 will push forward follower 465 which in its turn will open by the help of connecting rods 468 and 469 pullers 466 and 467 and they will become engaged with the rear part of machine 501. Then machine 502 should be switched over to reverse mode operation and the retracting process begins. The warning bulb should be on during the process of retracting. If it becomes off the engagement procedure, which is self explanatory, should be repeated. It should be noted that by means of a conventional electronic device the procedure of engaging pullers 426 and 427 (or 466 and 467) and switching over machine 502 from the forward mode operation to the reverse mode operation and vice versa can be controlled automatically.

The method of retracting from the underground hole a failed self-propelled soil penetrating machine by a similar or identical machine comprises in general the following steps:

a) connecting the ends of electrical wires 425 of the failed machine (machine 501) and a retracting machine (machine 502) on the control board to a source of current through a warning bulb or similar signalling device;

b) mounting front and rear expansion bushings 403 and 406 on machine 502 in case of heavy soil conditions, however for light soil conditions this step is not necessary;

c) mounting pulling accessory 420 (or 440, or 460) on chisel body 152*a* (or on chisel 152*c*) of machine 502;

d) feeding hoses 187 and 189 and wire 425 of said machine 501 through holes 423 and 424 (or holes in pipes 443 and 444) in puller body 422 (or 441) and keep hoses 187 and 189 in tension;

e) orienting the plane of directional stabilizers of machine 502 perpendicularly to the plane of stabilizers of machine 501 in the hole 418 made by machine 501;

f) directing machine 502 into hole 418 and switch on the forward mode operation of machine 502 letting it to penetrate into hole 418;

g) watching the warning bulb and when it comes on letting machine 502 continue to move forward for a short while and then switching over machine 502 to the reverse mode operation, and if the warning bulb comes off, machine 502 should be switched over to forward mode operation, and when the warning bulb comes again on machine 502 after a while should be again switched over to reverse mode operation, and these procedures should be repeated until the warning bulb is steady on, which confirms the normal proceeding of the process;

h) disengaging pullers 426 and 427 (or 466 and 467) from machine 501 after it was retracted from hole 418.

E. EXPANSION A HOLE

A hole made by an underground self-propelled soil penetrating machine can by expended to a certain extent by the same machine. Some of the existing machines use an expansion accessory that should be screwed in instead of the tail nut, and other existing machines use a complicated shell which is mounted on the front part of the machine.

FIGS. 14 and 19 illustrate relatively simple expansion accessories that are rigidly attached to the rear part of the machine. The assembling and functioning of these accessories is self explanatory.

I claim:

1. A monotube differential pneumopercussive self-propelled reversible soil penetrating machine with stabilizers, comprising:

a monotube elongated housing assembly, including a tube having internal threads in its front part for accommodating a chisel assembly, structurally shaped longitudinal directional stabilizers rigidly attached to the outside surface of said tube and creating between the inner surfaces of said stabilizers and outside surface of said tube longitudinal channels hermetically closed by appropriate plugs at both ends of each stabilizer and used for delivery and exhaust of compressed air;

a chisel assembly rigidly secured to the front part of said tube for accepting impact loading, including a chisel, a front anvil rigidly secured to said chisel, and a resilient sealing O-ring mounted in an appropriate groove of said chisel in order to prevent leakage of compressed air through the threaded connection of said chisel and said tube;

a rear anvil assembly rigidly secured inside of the rear part of said tube for accepting impact loading, including a rear anvil, a spring loaded follower slidably disposed in a longitudinal hole of said rear anvil, and means for securing said rear anvil inside of said tube;

a striker assembly slidably disposed inside of said tube between said rear anvil and said front anvil creating a forward stroke chamber between the rear end of said striker assembly and said rear anvil and a backward stroke chamber between the front end of said striker assembly and said front anvil, including a striker, a front bit rigidly secured to said striker, two bushings slidably mounted on both ends of said striker and having a slide fit with said tube,.and retaining rings mounted in appropriate grooves in said striker for keeping in place said bushings; and a differential air-distributing mechanism installed inside of the rear part of said tube immediately behind said rear anvil providing pneumatically control of the reciprocating motion of said striker which during forward mode operation of said machine is accelerated without restriction in order to impart an impact to said front anvil and is restricted to impart a slight impact to said rear anvil and during reverse mode operation of said machine is braked to avoid an impact to said front anvil or restricted to impart a slight impact to said front anvil and is accelerated without restriction in order to impart an impact to said rear anvil, including an adjustable by a pressure regulator nominal (high) air pressure line, an adjustable by a pressure regulator reduced (low) air pressure line, a rear valve chest carrying two barbs for hoses for said air lines, a spring loaded relief valve slidably disposed inside said rear chest for connecting by an additional air passage said forward stroke chamber with the atmosphere at the backward stroke of said striker during reverse mode operation of said machine, a coil spring disposed inside said rear valve chest to push said relief valve to its extreme right position, a front valve chest assembled with said tube by a press fit, a hollow stepped bushing accommodated by said rear and front valve chests and centering said rear and front valve chests, a stepped stroke control valve slidably disposed inside said front valve chest, a coil spring disposed in longitudinal central holes of said stepped stroke control valve and said follower and simultaneously loading said stepped stroke control valve and said follower in opposite directions, and a set of bolts securing said rear valve chest to said front valve chest.

2. The machine of claim 1, wherein said tube has a series of radial holes communicating with said closed longitudinal channels created between the outside surface of said tube and inner surfaces of said structurally shaped directional stabilizers for delivery and exhaust of compressed air.

3. The machine of claim 1, wherein the rear part of said machine has engaging means intended to engage with a pulling accessory in case of being retracted from a hole by another identical or similar machine, and further the front part of said machine has means to accommodate said pulling accessory in case of retracting from a hole a similar or identical machine.

4. A pulling accessory intended for retracting from a hole a failed monotube differential pneumopercussive self-propelled reversible soil penetrating machine with stabilizers comprising:

a puller body slidably mounted on the front part of a similar or identical retracting machine retaining the possibility of rotational motion around the longitudinal axes of said machine while being restricted from moving in the axial direction, and having appropriate passages letting to pass hoses and electrical wire of said failed machine;

pullers connected to said puller body and having means for engaging with the rear part of said failed machine; and means for controlling the engagement and disengagement of said pullers with said failed machine.

5. A method of retracting from a hole a failed monotube differential pneumopercussive reversible self-propelled soil penetrating machine with stabilizers by another identical or similar machine representing the retracting machine comprising following steps:

mounting on the front part of said retracting machine a pulling accessory including a puller body having holes therethrough;

passing hoses and electrical wire of said failed machine through said holes in said puller body;

connecting the wires of said failed machine and said retracting machine to an electrically operated indicator of engagement between said pulling accessory and said rear part of said failed machine;

driving said retracting machine into the hole made by said failed machine until said pulling accessory on said retracting machine engages with said failed machine; and reversing said retracting machine which in a tandem arrangement will retract said failed machine.

* * * * *